US007438557B1

(12) United States Patent
Plucinski et al.

(10) Patent No.: US 7,438,557 B1
(45) Date of Patent: Oct. 21, 2008

(54) STACKED MULTIPLE ELECTRONIC COMPONENT INTERCONNECT STRUCTURE

(75) Inventors: Mark D. Plucinski, Rochester, MN (US); Arvind Kumar Sinha, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/938,858

(22) Filed: Nov. 13, 2007

(51) Int. Cl.
*H01R 12/00* (2006.01)

(52) U.S. Cl. ..... 439/65; 439/66

(58) Field of Classification Search ..... 439/65, 439/66, 73, 70, 71, 330
See application file for complete search history.

(56) References Cited

U.S. PATENT DOCUMENTS 5,935,687 A 8/1999 Davidson et al.
6,435,883 B1 8/2002 Warren
6,590,159 B2 * 7/2003 Fan et al. ..... 174/541
6,903,941 B2 6/2005 Paola
7,160,119 B2 * 1/2007 Rathburn ..... 439/77

* cited by examiner

*Primary Examiner*—Tho D. Ta
*Assistant Examiner*—Travis Chambers
(74) *Attorney, Agent, or Firm*—Cantor Colburn LLP

(57) ABSTRACT

A stacked multiple electronic component interconnect structure includes a connector portion having a first and second connector surfaces. A first double sided land grid array having a first surface provided with a first plurality of connector units and a second surface provided with a second plurality of connector units, is positioned on the first connector surface. A second double sided land grid array having a first surface provided with a first plurality of connector units and a second surface provided with a second plurality of connector units is positioned on the second connector surface. A first electronic component is mounted to the second surface of the first land grid array and a second electronic component is mounted to the second surface of the second land grid array to form a stacked multiple electronic component interconnect structure that conserves space on an electronic board.

2 Claims, 1 Drawing Sheet

STACKED MULTIPLE ELECTRONIC COMPONENT INTERCONNECT STRUCTURE

BACKGROUND OF THE INVENTION

1. Field of the Invention

This invention relates to electronic component mounting and, more particularly, to a multiple electronic component interconnect structure that minimizes a footprint of electronic components mounted to a substrate.

2. Description of Background

Electronic components are mounted to circuit boards or other substrates using a variety of connector schemes. Conventionally, a pin grid array (PGA) interface was used to mount a processor to a processor socket on a printed circuit board. A pin grid array includes a number of pins, typically on the processor, that mate with corresponding pin acceptors on the processor socket. More recently, ball grid array (BGA) and land grid array (LGA) interfaces are being used to connect processors and circuit boards. Unlike the PGA interface, a chip mounted with a BGA or LGA interface does not include pins. In place of pins, the chip is provided with gold or copper plated balls or pads that touch pins provided on the circuit board. BGA and LGA interfaces provide a larger contact point that allows a processor to run at higher clock frequencies. In addition, the increased contact area in BGA and LGA interfaces provides a more efficient power connection. Unfortunately, to provide the increased contact area, the contact pads require more surface area than, for example, pins and available space on printed circuit boards is practically non-existent. As electrical devices shrink in size, space available for additional electronic components is at a premium.

SUMMARY OF THE INVENTION

The shortcomings of the prior art are overcome and additional advantages are provided through the provision of a stacked multiple electronic component interconnect structure. The interconnect structure includes a connector portion having a first connector surface provided with a first plurality of connector pads and a second connector surface provided with a second plurality of connector pads. A first double sided land grid array having a first surface provided with a first plurality of connector units and a second surface provided with a second plurality of connector units is positioned on the first connector surface. The first plurality of connector units of the first double sided land grid array interface with the first plurality of connector pads. A second double sided land grid array having a first surface provided with a first plurality of connector units and a second surface provided with a second plurality of connector units is positioned on the second connector surface. The first plurality of connector units of the second double sided land grid array interface with the second plurality of connector pads. In addition, a first electronic component is mounted to the second surface of the first land grid array. The first electronic component includes a plurality of connector members that interface with the second plurality of connector units of the first double sided land grid array. Finally, a second electronic component is mounted to the second surface of the second land grid array. The second electronic component is provided with a plurality of connector members that interface with the second plurality of connector units of the second double sided land grid array to form a stacked multiple electronic component interconnect structure that conserves space on an electronic board.

Additional features and advantages are realized through the techniques of exemplary embodiments of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

Figure 1:
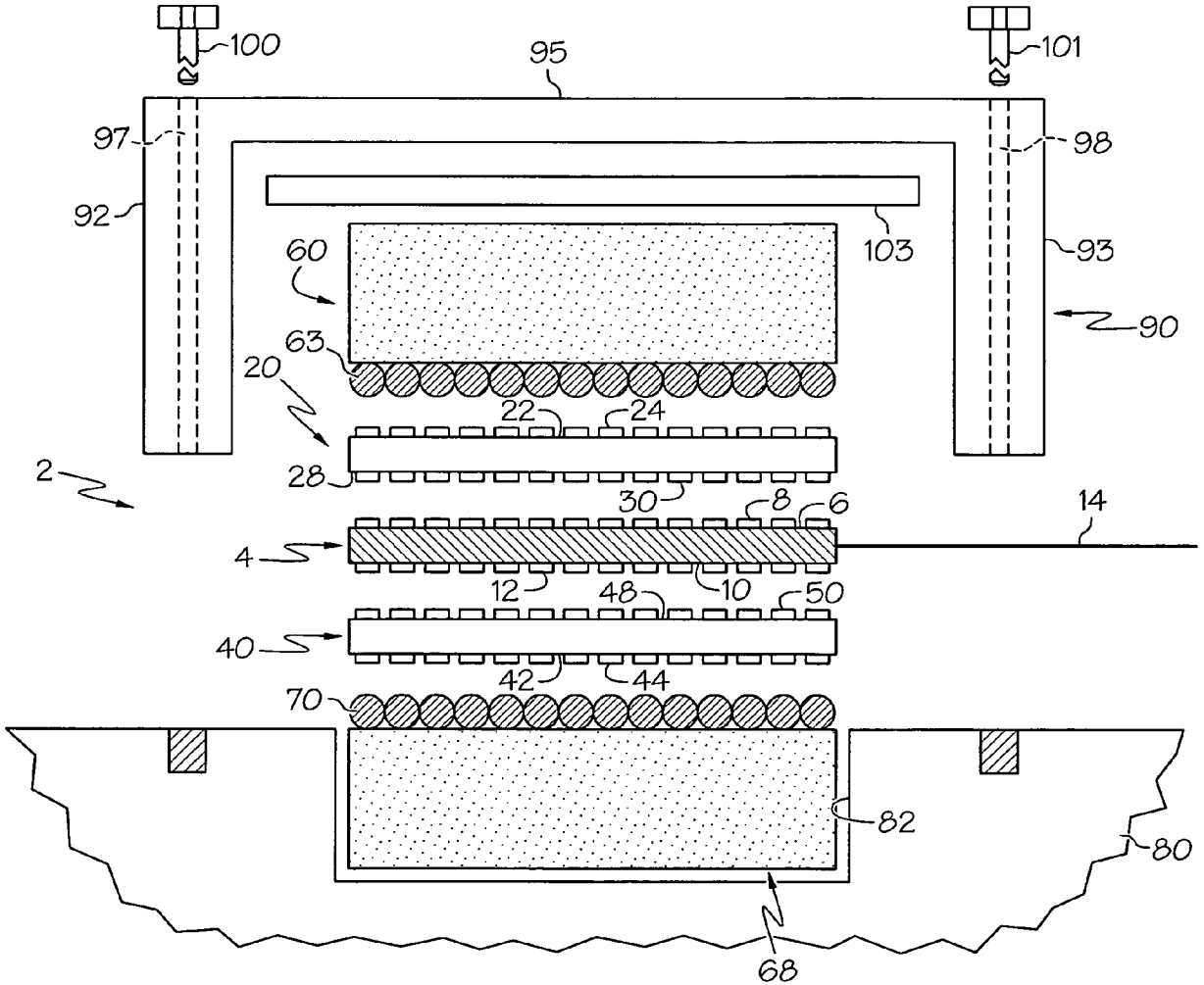
FIG. 1 is an exploded schematic view of a stacked multiple electronic component interconnect structure constructed in accordance with an exemplary embodiment of the present invention.

The detailed description explains exemplary embodiments of the invention, together with advantages and features, by way of example with reference to the drawing.

DETAILED DESCRIPTION OF THE INVENTION

Turning now to the drawing in greater detail, it will be seen that in FIG. 1 a stacked multiple electronic component interconnect structure constructed in accordance with an exemplary embodiment of the present invention is indicated at 2. Interconnect structure 2 includes a connector portion 4 having a first connector surface 6 provided with a first plurality of connector pads 8 and a second connector surface 10 provided with a second plurality of connector pads 12. A cable 14 extends from connector portion 4 and provides an interface to an associated electronic device (not shown). In accordance with one aspect of the present invention, connector portion 4 is a flex cable that provides a flexible interface for interconnect structure 2. In accordance with another aspect of the present invention, connector portion 4 is a thin circuit board. In any case, connector portion 4 is mounted between two double sided land grid array (LGA) surfaces in manner that it will be detailed more fully below.

As shown, interconnect structure 2, includes a first doubled sided land grid array 20 having a first surface 22 provided with a first plurality of connector units 24 and a second surface 28 provided with a second plurality of connector units 30. Second surface 28 is configured to engage with first connector surface 6 of connector portion 4 with the second plurality of connector units 30 interfacing with the plurality of connector pads 8 to provide an electrical connection. Interconnect structure 2 is further shown to include a second, doubled sided land grid array 40 having a first surface 42 provided with a first plurality of connector units 44 and a second surface 48 provided with a second plurality of connector units 50. Second surface 48 of second double sided land grid array 40 is designed to interface with second connector surface 10 of connector portion 4 with the second plurality of connector units 50 engaging with the second plurality of connector pads 12 to provide an electrical connection.

A first electronic component 60, such as processor or integrated circuit (IC) chip, having a plurality of connector members 62 is mounted to first double sided land grid array 20. More specifically, first electronic component 60 is mounted to first surface 22 of first double sided land grid array 20 with the plurality of connector members 62 interfacing with the first plurality of connector units 24. In a similar manner, a second electronic component 68, such as processor, integrated circuit chip, or one having a plurality of connector members 70 is mounted to second land grid array 40. More specifically, second electronic component 68 is mounted to first surface 42 of second double sided land grid array 40 with the plurality of connector members 70 interfacing with the first plurality of connector units 44 to provide an electrical connection.

In the exemplary embodiment shown, second electronic component 68 is mounted to a circuit board 80. More specifically, second electronic component 68 is mounted within an electronic component receiving cavity 82 formed within circuit board 80. However it should be recognized that Second electronic component 68 can interface with a socket provided on a circuit board 80 or, as shown in the exemplary embodiment, be mounted within an electronic component receiving cavity 82 to provide a first interface with the electronic device (not shown). By stacking first and second electronic components 60 and 68, multiple electrical components can be provided in the same area that would heretofore be reserved for a single electronic component. Moreover, the use of connector member 4 provides additional interface structure that expands the overall interconnectivity capabilities of interconnect structure 2.

In any event, once electrical connections are established between connector member 4 and first and second land grid arrays 20 and 40, and first and second electrical components 60 and 68, a force member 90 is mounted to circuit board 80. Force member 90 ensures that the electrical connections within interconnect structure 2 remain intact during vibration, movement and the like of the associated electronic device. Force member 90 is shown to include first and second support portions 92 and 93 joined through a connecting member 95. Each support portions 92, 93, includes a corresponding longitudinally standing bore 97, 98. A pad 103 is provided between connector member 95 and first electronic component 60 to provide vibration absorption and allow proper force to be applied to interconnect structure 2 without damaging component 60.

At this point, it should be appreciated that the present invention provides for a interconnect structure that enables multiple electronic components to occupy a footprint previously used to only a single electronic component. While the preferred embodiment of the invention has been described, it will be understood that those skilled in the art, both now and in the future, may make various improvements and enhancements which fall within the scope of the claims which follow.

The invention claimed is:

1. A stacked multiple electronic component interconnect structure comprising:

a connector portion including a first connector surface provided with a first plurality of connector pads and a second connector surface provided with a second plurality of connector pads, wherein the connector portion is a flexible cable having a first plurality of conductors operatively connected to the first plurality of connector pads and a second plurality of conductors operatively connected to the second plurality of connector pads, the first plurality of conductors being distinct from the second plurality of conductors;

a first double sided land grid array having a first surface provided with a first plurality of connector units and a second surface provided with a second plurality of connector units, the first surface being positioned on the first connector surface with the first plurality of connector units of the first double sided land grid array interfacing with the first plurality of connector pads;

a second double sided land grid array having a first surface provided with a first plurality of connector units and a second surface provided with a second plurality of connector units, the first surface being positioned on the second connector surface with the first plurality of connector units of the second double sided land grid array interfacing with the second plurality of connector pads;

a first electronic component mounted to the second surface of the first double sided land grid array, the first electronic component having a plurality of connector members that interface with the second plurality of connector units of the first double sided land grid array;

a second electronic component mounted to the second surface of the second doubled sided land grid array, the second electronic component having a plurality of connector members that interface with the second plurality of connector units of the second double sided land grid array to form a stacked multiple electronic component interconnect structure that conserves space on an electronic board; and a circuit board having an electronic component interface cavity, the second electronic component being mounted in the electronic component interface cavity.

2. The stacked multiple electronic component interconnect structure according to claim 1, further comprising: a force member positioned to apply a compressive force to the stacked multiple electronic component interconnect structure to maintain electrical contact between the first and second electronic components and the first and second double sided land grid arrays respectively.

* * * * *